US006540133B1

(12) United States Patent
Chou

(10) Patent No.: US 6,540,133 B1
(45) Date of Patent: Apr. 1, 2003

(54) FOLDABLE CARRYING HANDLE FOR A PORTABLE LUNCHBOX

(76) Inventor: Hsin-Hung Chou, No. 2, Alley 2, Lane 250, Wen Chang Street, Taipei City (TW)

( * ) Notice: Subject to any disclaimer, the term of this patent is extended or adjusted under 35 U.S.C. 154(b) by 0 days.

(21) Appl. No.: 10/243,713

(22) Filed: Sep. 16, 2002

(51) Int. Cl.[7] ..... B65D 5/46

(52) U.S. Cl. ..... 229/117.22; 220/763; 220/770; 229/117.25; 229/911

(58) Field of Search ..... 229/114, 117.22, 229/117.25, 117.26, 910, 911, 912; 220/757, 761, 762, 763, 764, 770; 16/110.1, 429

(56) References Cited

U.S. PATENT DOCUMENTS

| | | | | | |
|---|---|---|---|---|---|
| 2,405,310 | A | * | 8/1946 | Larkin | 229/117.22 |
| 2,427,004 | A | * | 9/1947 | Kampf | 16/429 |
| 2,918,206 | A | * | 12/1959 | Kleingers, Jr. | 229/117.22 |
| 3,206,104 | A | * | 9/1965 | Cohen | 229/117.26 |
| 3,587,699 | A | * | 6/1971 | Kovach | 229/117.26 |
| 4,905,888 | A | * | 3/1990 | Suoss et al. | 229/117.22 |
| 4,985,932 | A | * | 1/1991 | Bezdek | 229/114 |
| 5,050,760 | A | * | 9/1991 | Garcia | 220/763 |
| 5,275,331 | A | * | 1/1994 | Chung-Piao | 229/117.14 |
| 5,299,732 | A | * | 4/1994 | Armor et al. | 229/117.25 |
| 5,458,270 | A | * | 10/1995 | Tsao | 229/117.15 |

FOREIGN PATENT DOCUMENTS

| | | | | |
|---|---|---|---|---|
| FR | 2653748 | A1 * | 5/1991 | 229/117.26 |

* cited by examiner

*Primary Examiner*—Gary E. Elkins
(74) *Attorney, Agent, or Firm*—Rosenberg, Klein & Lee

(57) ABSTRACT

The present invention relates to a foldable carrying handle for a portable lunch-box which is made of plastic and consists of seven pieces which are hingedly interconnected into one-part bar-shaped body. The one-part bar-shaped body includes a cross bar, two upper overlapping pieces, two lower overlapping pieces and two positioning pieces. The cross bar corresponds to the width of the lunchbox and is positioned at the center of the bar-shaped body. The two upper overlapping pieces are symmetrically disposed at both ends of the cross bar. The two lower overlapping pieces are symmetrically disposed at outer end of both upper overlapping pieces. The two positioning pieces having finger-shaped fastener are symmetrically disposed at outer end of both lower overlapping pieces. The finger-shaped fasteners of the two positioning pieces are inserted into connection holes at both sides of the lunchbox in such a way that the cross bar is situated atop while the upper overlapping pieces and the lower overlapping pieces vertically extend at both sides, thereby forming an inverted U-shaped carrying handle. When the cross bar is pressed downwards, the upper overlapping pieces and the lower overlapping pieces are inwardly folded at the edges. A one-part fastening device is formed on the cross bar or the lower overlapping pieces so as to fix the carrying handle in place when folded.

8 Claims, 13 Drawing Sheets

FOLDABLE CARRYING HANDLE FOR A PORTABLE LUNCHBOX

BACKGROUND OF THE INVENTION

1. Field of the Invention

The present invention relates to a foldable carrying handle for a portable lunchbox, and more particularly, to a handle which is foldable and fixed on the top of the lunchbox for locking the lunchbox in position. Therefore, the lunchboxes can be conveniently piled up.

2. Description of the Prior Art

A one-part portable lunchbox 50 disclosed in U.S. Pat. No. 5,275,331 and shown in FIGS. 1 and 2, is created in sticking way. A carrying handle 51 is formed at the top of the lunchbox 50. Since this kind of portable lunchbox has to be fixed in sticking way, the consumer can't develop the lunchbox 50. Unlike the food on a food tray, the food carried within this lunchbox can't be clearly seen. As a result, this is not completely accepted by European.

Another portable lunchbox 52 disclosed in U.S. Pat. No. 5,458,270 and shown in FIG. 3 is created by insertingly interlocking way. Moreover, A carrying handle 53 is formed at the top of the lunchbox 52. In order to avoid the loose configuration of the portable lunchbox 52, a multi-interlocking mechanism has to be used to ensure a firm structure. However, the multi-interlocking mechanism also has the drawback that the lunchbox 52 is not easy to be developed and, therefore, it won't be accepted well.

A further portable lunchbox for edible material disclosed in TW 484604 includes four sideplates 54 which are hingedly connected with a foldable piece 55, respectively. Meanwhile, every two foldable pieces 55 are connected to each other. An interlocking hole 56 is provided at the overlapping part so as to receive the respective end of a carrying handle 57. As a result, the lunchbox is formed by means of the interlocking of the carrying handle 57. However, the lunchbox loses its form-shaping force when the carrying handle 57 is removed from the interlocking holes 56, thereby being easily developed. As a result, it's widely accepted since the food inside is received as if within a food tray. However, the carrying handle 57 can't lock the top side of the lunchbox in position, thereby affecting the piling of the lunchboxes.

Still another portable lunchbox 58 for edible material, as shown in FIGS. 5 and 6, has a carrying handle 59 made of metal wire. The carrying handle 59 is bendable and therefore won't affect the piling of the lunchboxes 58; however, the metal can't be heated by microwave. As a result, the carrying handle 59 has to be removed first before the food inside is heated by microwave. And this will cause the loosened structure of the lunchbox 58, thereby dispersing the food. Consequently, it's unfavorable to be heated in microwave oven.

SUMMARY OF THE INVENTION

It is a primary object of the present invention to provide a carrying handle for a portable lunchbox which is convenient for use.

It is another object of the present invention to provide a carrying handle for a portable lunchbox which is foldable into flat shape so as to lock the top of the lunchbox in position. Meanwhile, the lunchboxes can be piled up for saving space.

It is a further object of the present invention to provide a carrying handle for a portable lunchbox, wherein the carrying handle can be microwave-heated together with the lunchbox without affecting the microwave heating procedure.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 7:
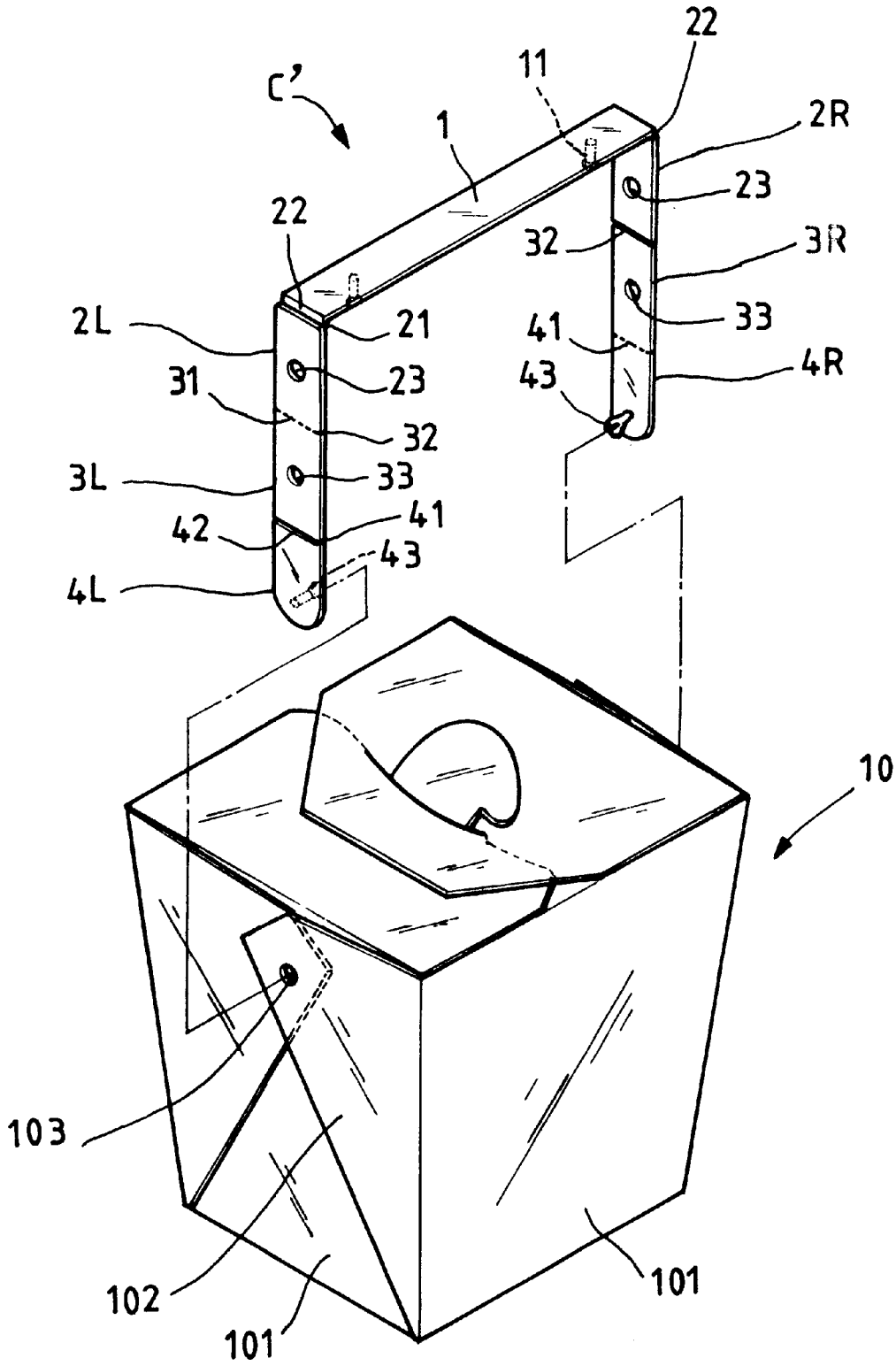
FIG. 7 is a perspective view of a first embodiment of the present invention before connection to the lunchbox.

First of all, referring to FIG. 7, the developable lunchbox 10 is provided with hingedly foldable connection pieces 102 between four side plates 101. Every two foldable connection pieces 102 are overlapped to each other. A connection hole 103 is arranged at the overlapping place of the foldable connection pieces 102.

The lunchbox is formed by inserting both ends of the carrying handle into the connection holes 103. The present invention is connected to the above-mentioned lunchbox. The lunchbox itself is not the object of the present invention so that no further descriptions are given hereinafter.

Figure 8:
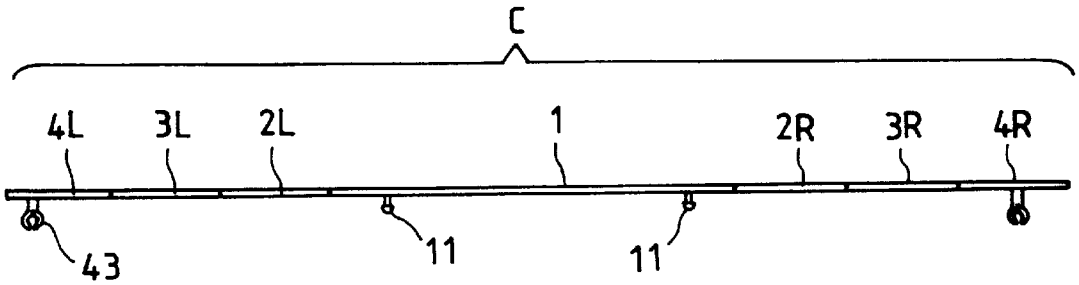
FIG. 8 is a side view of the first embodiment of the present invention.
Figure 9:
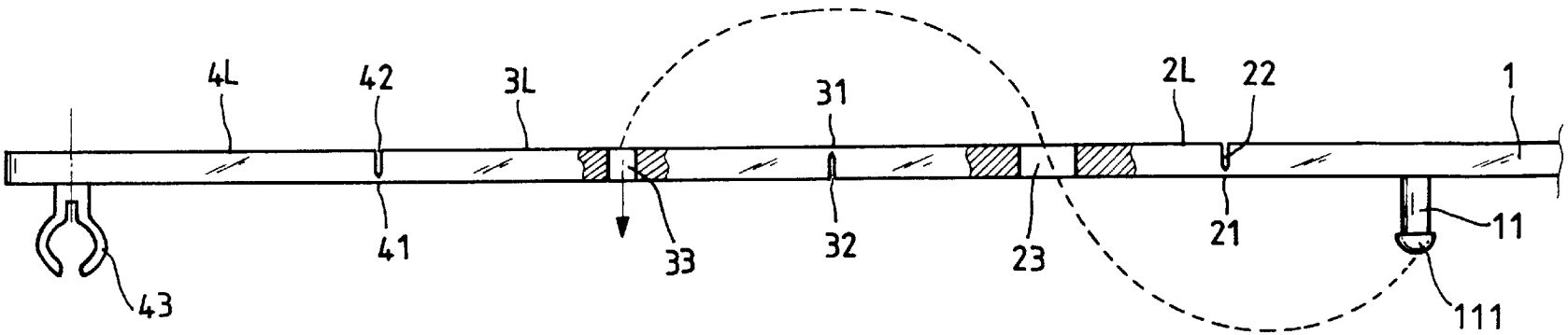
FIG. 9 is an enlarged view of the first embodiment of the present invention.

Again, referring to FIG. 7 together with FIGS. 8 and 9, the carrying handle of the present invention is made of plastic and consists of seven pieces which are hingedly interconnected into one-part bar-shaped body C. The one-part bar-shaped body C includes a cross bar 1, two upper overlapping pieces 2L, 2R, two lower overlapping pieces 3L, 3R and two positioning pieces 4L, 4R. The cross bar 1 corresponds to the width of the lunchbox 10 and is positioned at the center of the bar-shaped body C. The two upper overlapping pieces 2L, 2R are symmetrically disposed at both ends of the cross bar 1 and hingedly interconnected thereto through slimmer inner edges 21, respectively, in such a way that top slots 22 formed are directed outwards. The two lower overlapping pieces 3L, 3R are symmetrically disposed at outer end of both upper overlapping pieces 2L, 2R and hingedly interconnected thereto through slimmer outer edges 31, respectively, in such a way that middle slots 32 formed are directed inwards. The two positioning pieces 4L, 4R are symmetrically disposed at outer end of both lower overlapping pieces 3L, 3R and hingedly interconnected thereto through slimmer inner edges 41, respectively, in such a way that lower slots 42 formed are directed outwards. Moreover, a finger-shaped fastener 43 is positioned on the inner side of the two positioning pieces 4L, 4R, respectively.

The finger-shaped fasteners 43 of the two positioning pieces 4L, 4R are inserted into connection holes 103 at both sides of the lunchbox 10 in such a way that the cross bar 1 is situated atop while the upper overlapping pieces 2L, 2R and the lower overlapping pieces 3L, 3R vertically extend at both sides, thereby forming an inverted U-shaped carrying handle C'. When the cross bar 1 is pressed downwards, the upper overlapping pieces 2L, 2R and the lower overlapping pieces 3L, 3R are inwardly folded at the edges 21, 31, 41.

A one-part fastening device is formed on the cross bar 1 or the lower overlapping pieces 3L, 3R so as to fix the carrying handle in place when folded.

The two positioning pieces 4L, 4R are placed on both sides of the lunchbox 10 in upright state in such a way that the lower slots 42 just lean against the edge of the lunchbox 10. Accordingly, the lower overlapping pieces 3L, 3R are able to lie flat on the top surface of the lunchbox 10 when they are inwardly folded.

Figure 1:
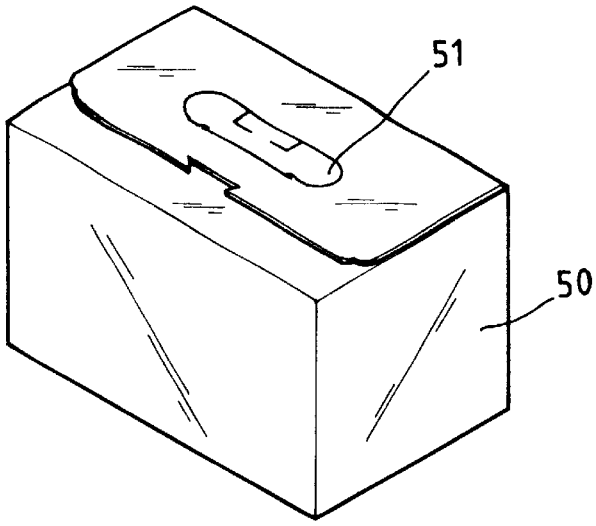
FIG. 1 PRIOR ART
FIG. 1 is a perspective view of a first conventional one-part lunchbox.
Figure 2:
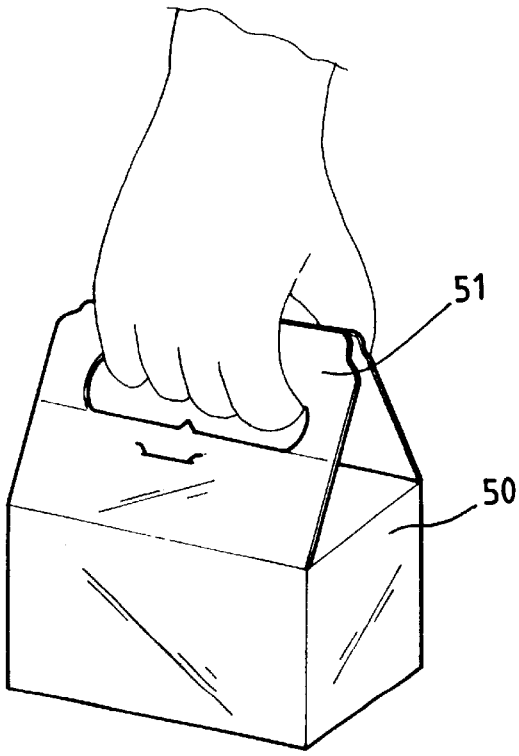
FIG. 2 PRIOR ART
FIG. 2 is a perspective view of the first conventional one-part lunchbox carried by one hand.
Figure 3:
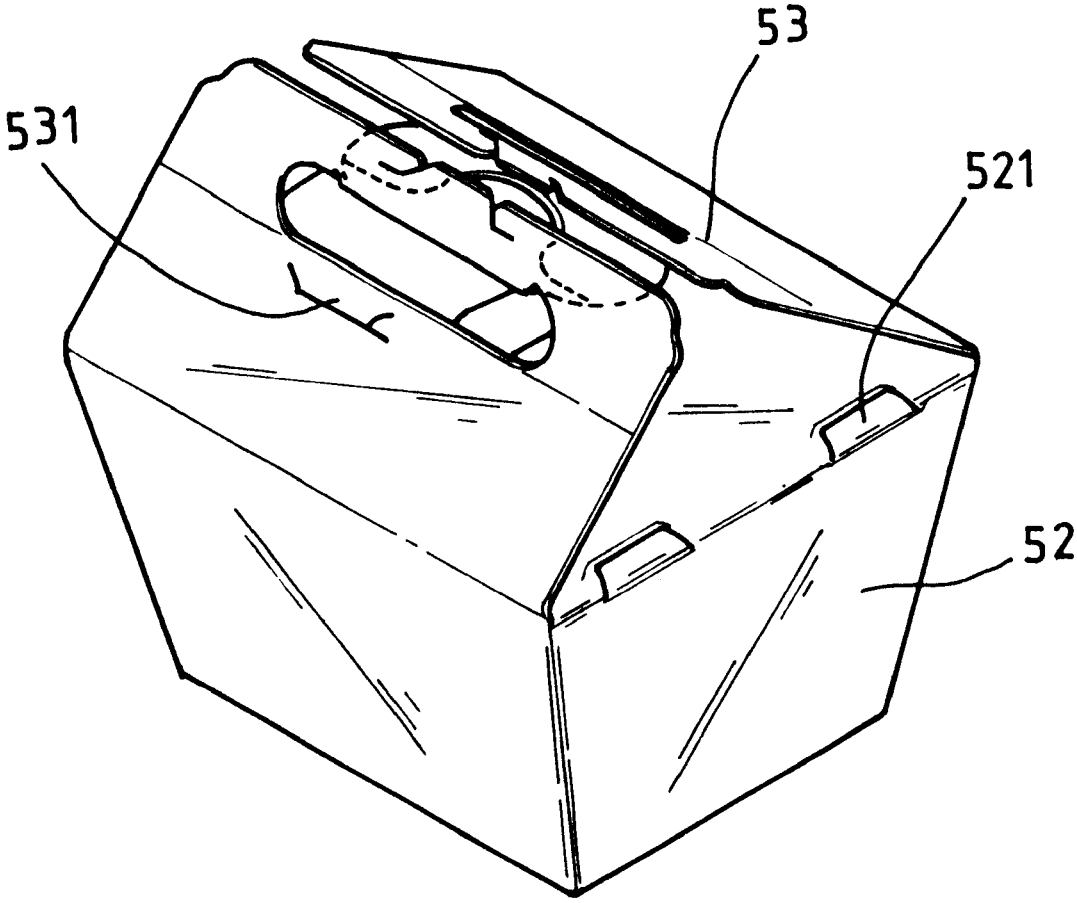
FIG. 3 PRIOR ART
FIG. 3 is a perspective view of a second conventional one-part lunchbox.
Figure 4:
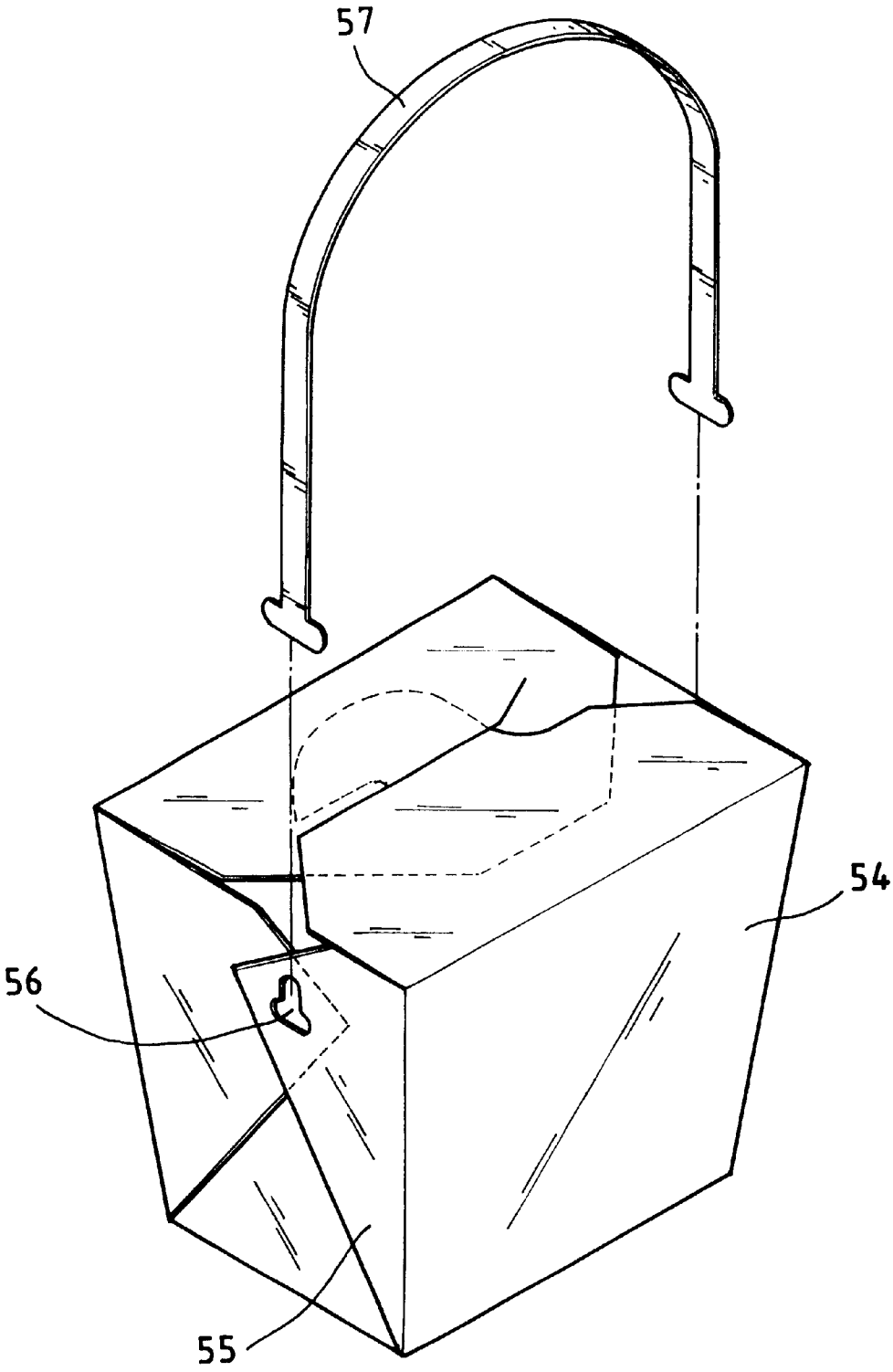
FIG. 4 PRIOR ART
FIG. 4 is a perspective view of a first conventional developable lunchbox.
Figure 5:
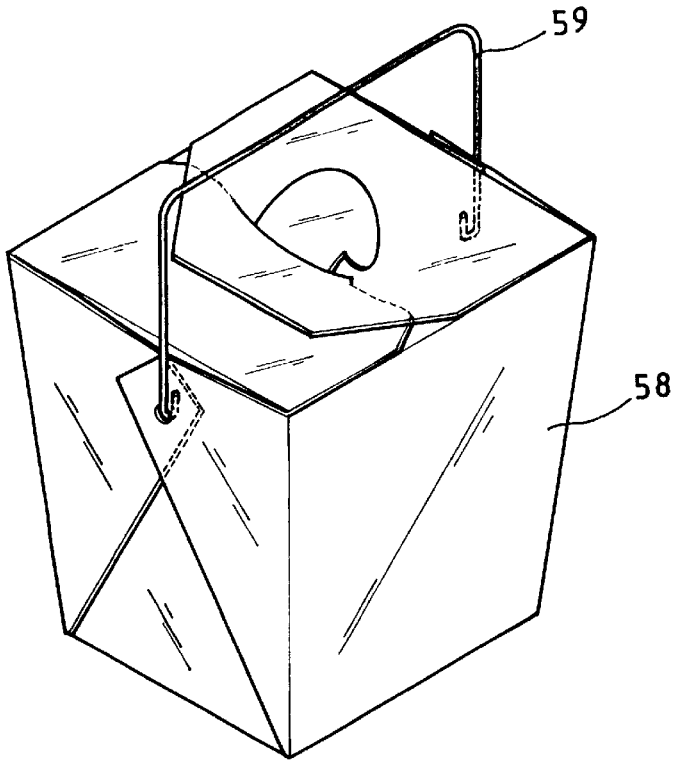
FIG.5 PRIOR ART
FIG. 5 is a perspective view of a second conventional developable lunchbox.
Figure 6:
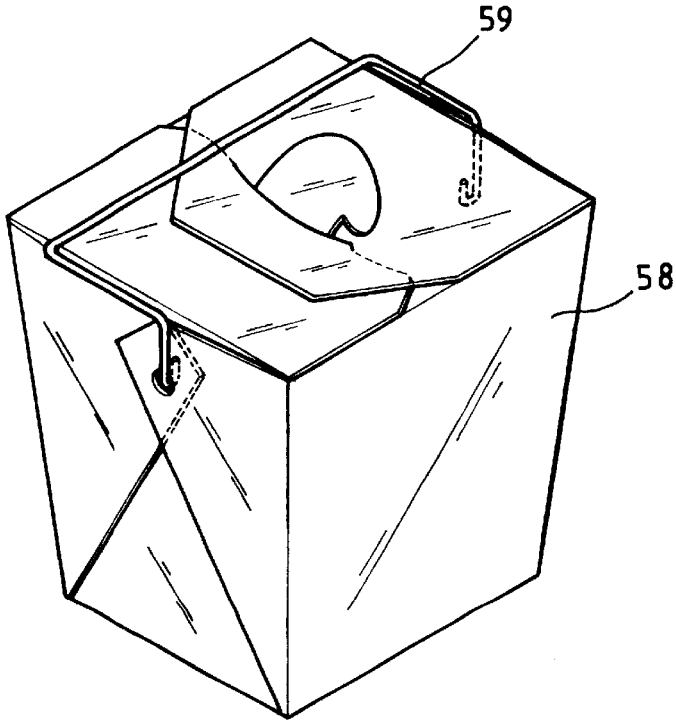
FIG.6 PRIOR ART
FIG. 6 is a perspective view of the second conventional developable lunchbox with a carrying handle folded on the top of the lunchbox.
Figure 12:
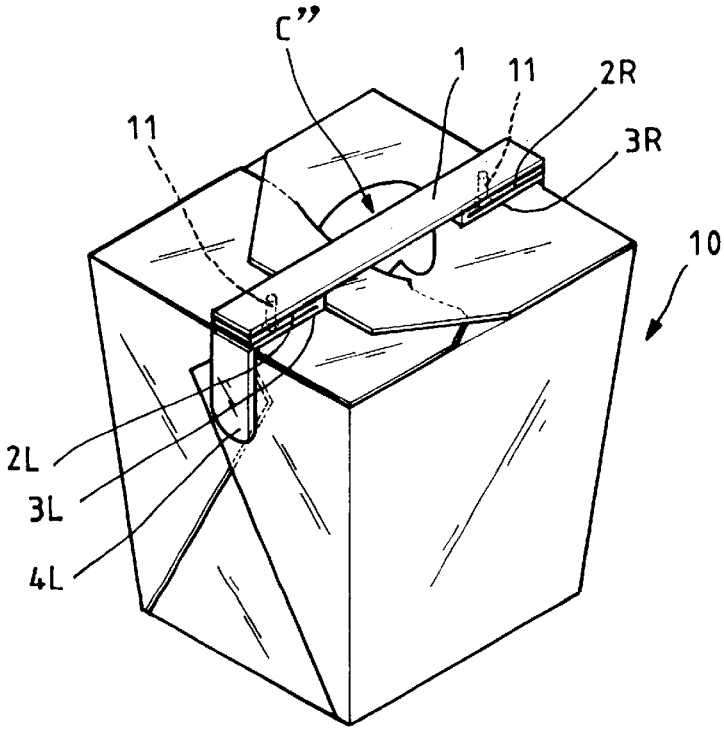
FIG. 12 is a perspective view of the lunchbox with the first embodiment of the present invention in folded state.

Based on the above-mentioned technique, as shown in FIG. 1, the normal use state of the carrying handle C' in accordance with the present invention is in an inverted U-shaped. When the lunchboxes 10 are piled up for convenient transport, the cross bar 1 have to be pressed downward (see FIG. 10) first. Meanwhile, the upper and lower overlapping pieces 2L, 2R, 3L, 3R can be folded to each other in the opposite direction of the slots 22, 32, 42 through the interconnected inner and outer edges 21, 41, 31. Thereafter, the carrying handle can be folded as shown in FIG. 12 which won't affect the delivery of the lunchboxes 10. Meanwhile, the top surface of the lunchbox 10 can be fixed in place. Consequently, the use thereof is very convenient.

Figure 10:
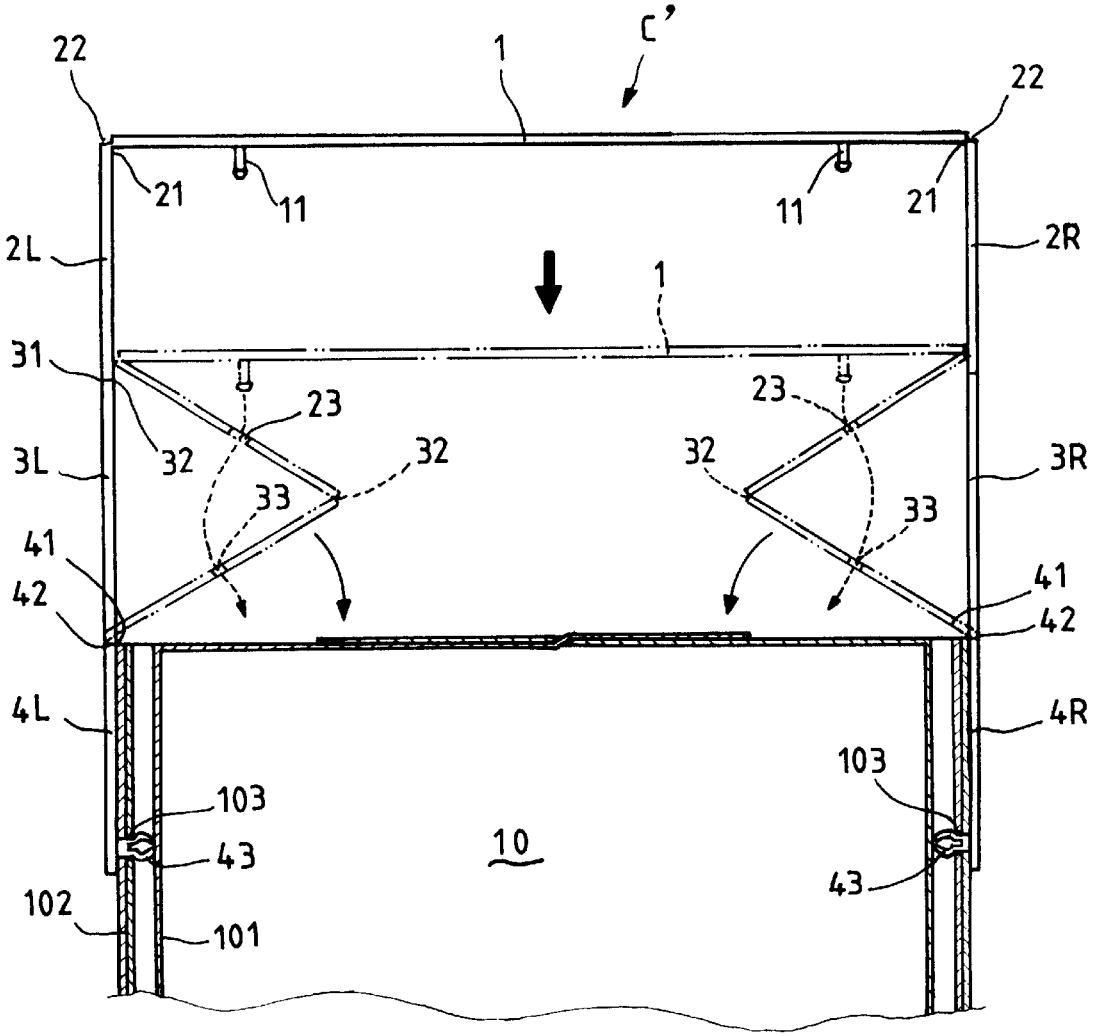
FIG. 10 is a schematic drawing of the first embodiment of the present invention showing the folding process thereof.
Figure 11:
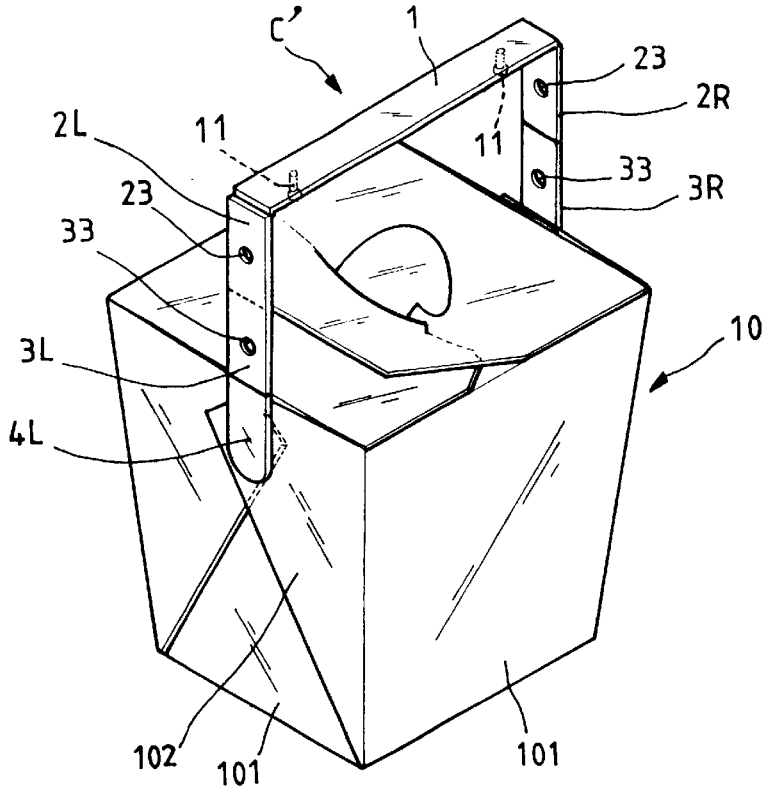
FIG. 11 is a perspective view of the lunchbox with the first embodiment of the present invention in developed state.

In order to fix the carrying handle C" onto the top surface of the lunchbox 10 when the carrying handle is folded, two locking studs 11 are arranged on the inner side of the cross bar 1. In folding the above-mentioned carrying handle C', the locking studs 11 go through the through holes 23 of the upper overlapping pieces 2L, 2R, respectively. The diameter of the through holes 23 is larger than that of the locking studs 11 so that the locking studs 11 can smoothly pass through them. Thereafter, the locking studs 11 are engaged into the positioning holes 33 of the lower overlapping pieces 3L, 3R. Since the ends 111 of the locking studs 11 are thickened, they are locked in place within the positioning holes 33. The engaging and folding process is shown in FIGS. 9 and 10. Accordingly, the developed state (see FIG. 11) of the carrying handle can be conveniently changed into the folded state (see FIG. 12) thereof only by pressing it down without any tools.

Figure 13:
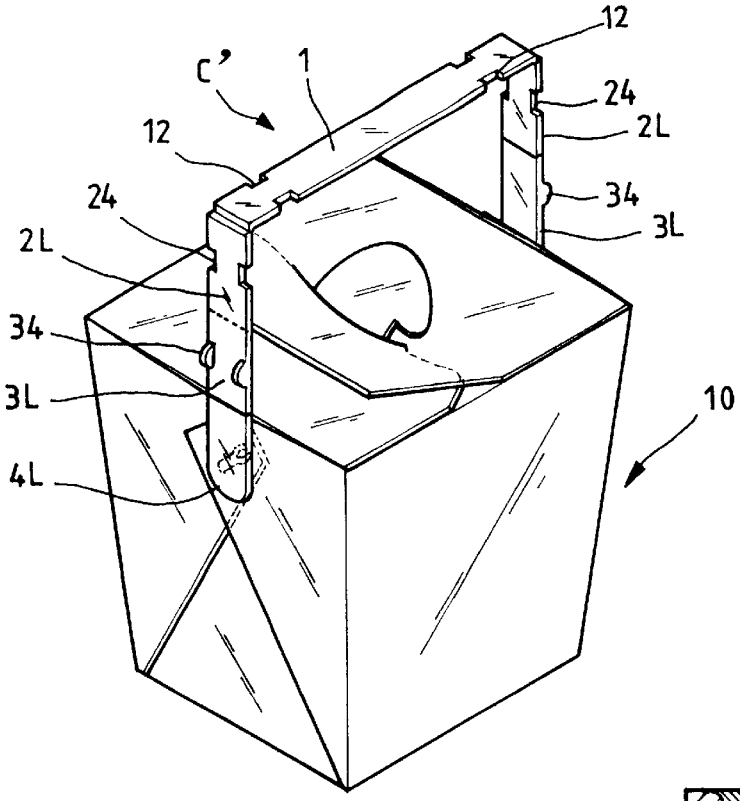
FIG. 13 is a perspective view of the lunchbox with a second embodiment of the present invention in developed state.
Figure 15:
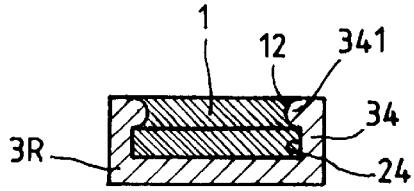
FIG. 15 is a sectional view taken along the line of 15—15 in FIG. 14.
Figure 14:
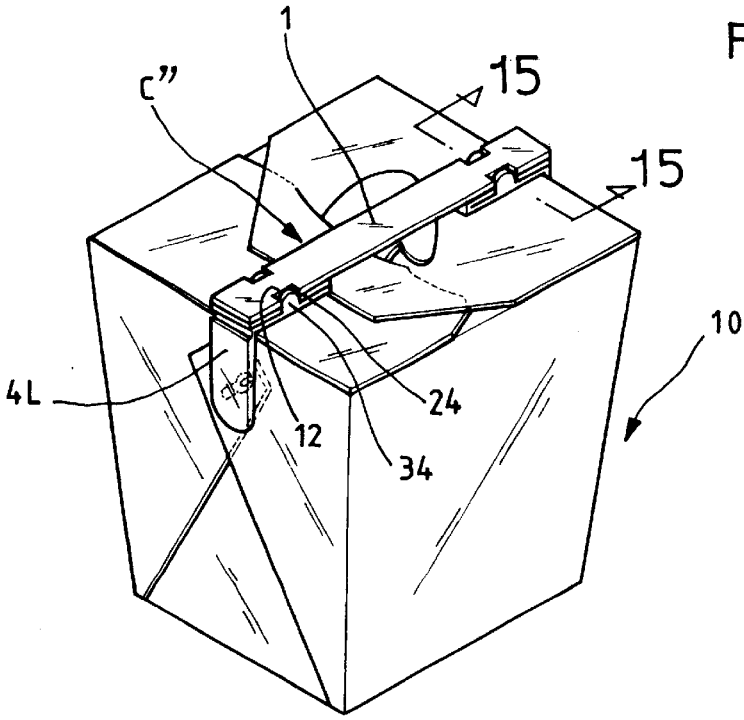
FIG. 14 is a perspective view of the lunchbox with the second embodiment of the present invention in folded state.
Figure 16:
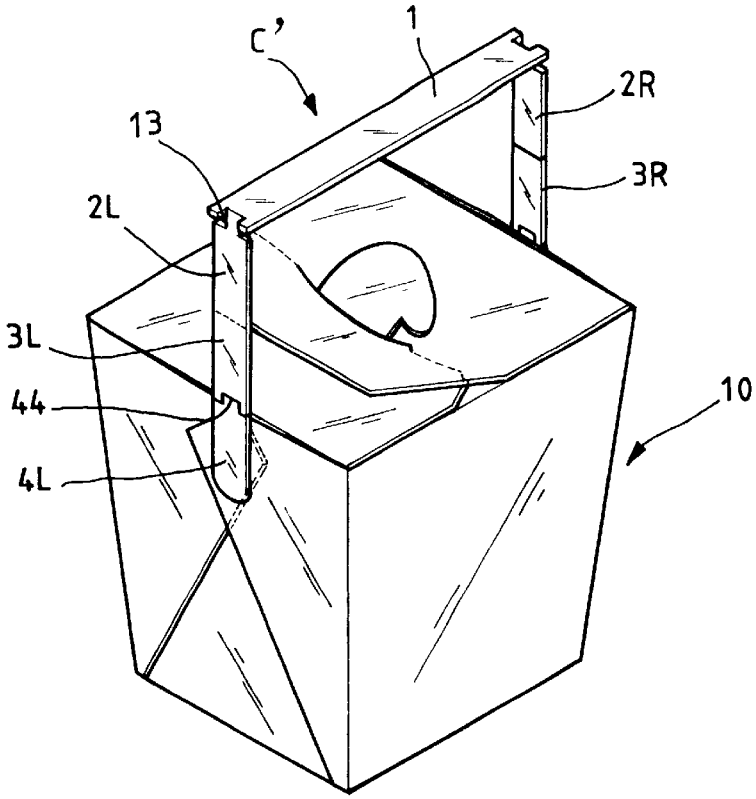
FIG. 16 is a perspective view of the lunchbox with a third embodiment of the present invention in developed state.
Figure 17:
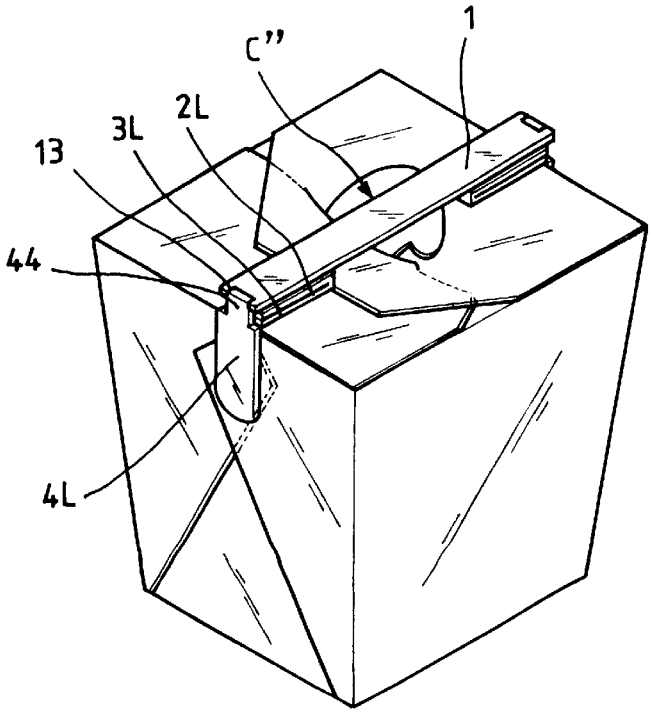
FIG. 17 is a perspective view of the lunchbox with the third embodiment of the present invention in folded state.
Figure 18:
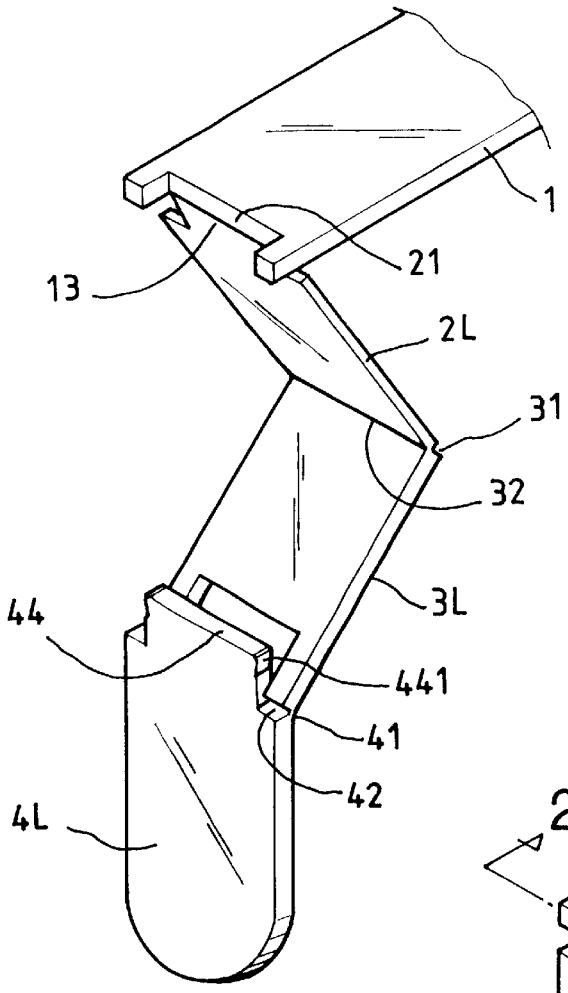
FIG. 18 is an enlarged perspective view of the third embodiment of the present invention.
Figure 19:
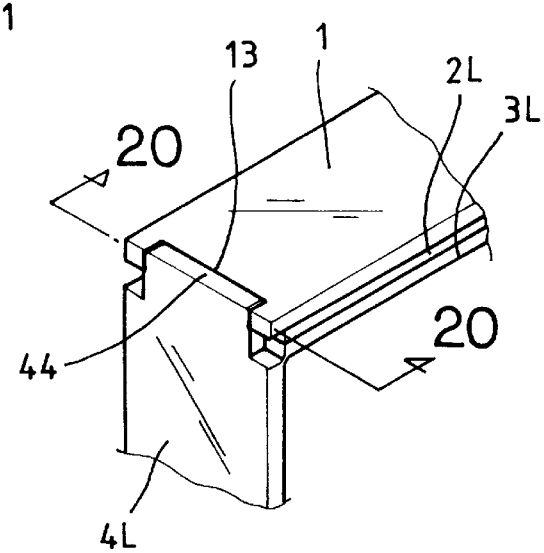
FIG. 19 is another enlarged perspective view of the third embodiment of the present invention.
Figure 20:
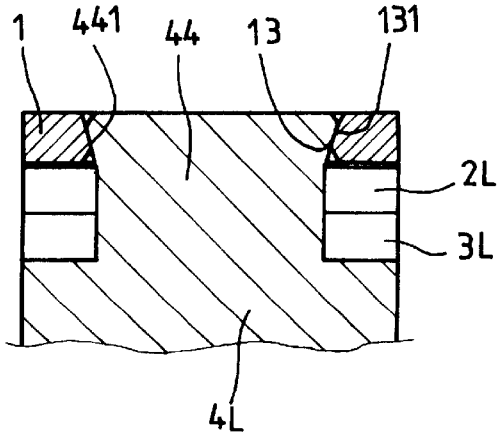
FIG. 20 is a sectional view taken along the line of 20—20 in FIG. 19.

Based on the above-mentioned thought that the inverted U-shaped carrying handle C' is brought into the folded state C", another applicable embodiment is shown in FIGS. 13 through 15. Each of the lower overlapping pieces 3L, 3R has two protruding pieces 34 while each of the upper overlapping pieces 2L, 2R and the cross bar 1 have two indentations 24, 12. When the inverted U-shaped carrying handle C' (see FIG. 13) is brought into the folded state C" (see FIG. 14), the protruding pieces 34 of the lower overlapping pieces 3L, 3R are correspondingly engaged into the indentations 24, 12 of the upper overlapping pieces 2L, 2R and the cross bar 1. The protruding pieces 34 are formed with the lower overlapping pieces 3L, 3R into one body. And the protruding pieces 34 are arranged opposite to each other. The protruding pieces 34 are engaged into the indentations 24, 12 by means of thickened members 341 at the inner side of the protruding pieces 34, thereby achieving the folding and fixing effects.

Furthermore, a further applicable embodiment for folding and fixing the carrying handle of the present invention in place is shown in FIGS. 16 through 20. Each of the two positioning pieces 4L, 4R has a projecting member 44 while the cross bar 1 has engaging indentations 13 at both ends thereof. The lower overlapping pieces 3L, 3R are hingedly interconnected on both shoulders at both sides of the projecting members 44 through an inner edge 41, and the gap 42 is directed outwards. Accordingly, the projecting member 44 protrudes in connection with the engaging indentation 13. The engaging indentation 13 has sloping sides 131 which correspond to tapered sides 441 at the top of the projecting member 44. Accordingly, the carrying handle C' can be folded in place in the state shown in FIG. 17.

Figure 21:
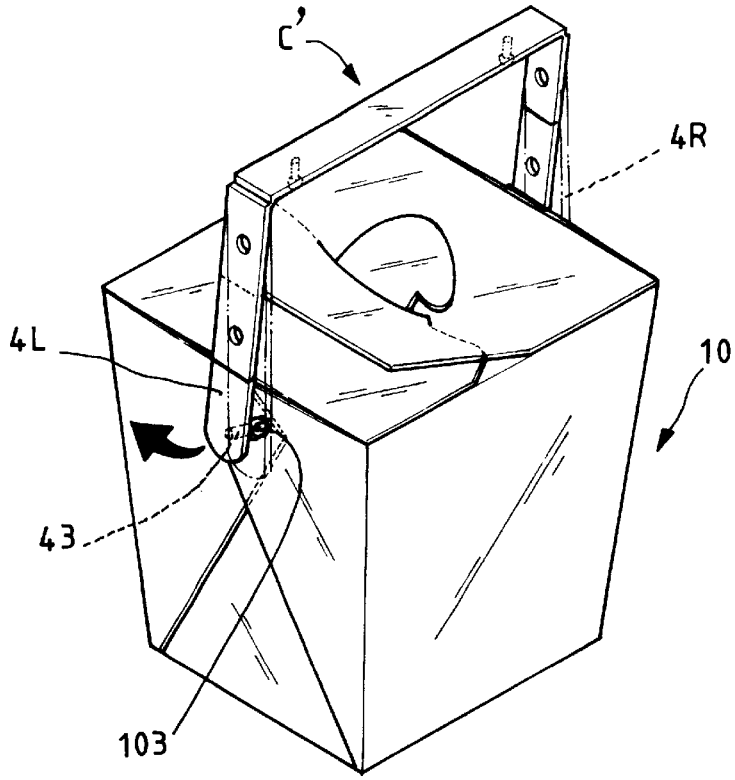
FIG. 21 is a perspective view of the lunchbox with the first embodiment of the present invention in developed state while positioning pieces are detached from the lunchbox.
Figure 22:
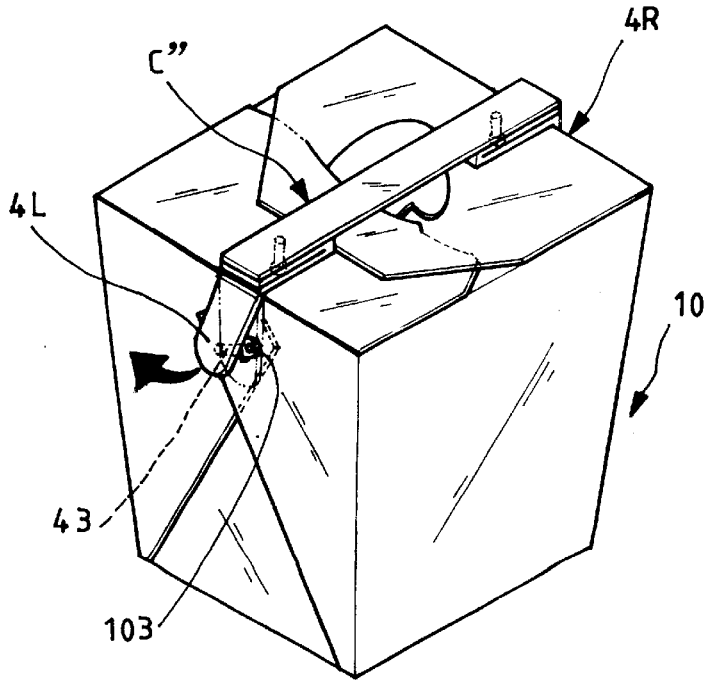
FIG. 22 is a perspective view of the lunchbox with the first embodiment of the present invention in folded state while the positioning pieces are detached from the lunchbox.
Figure 23:
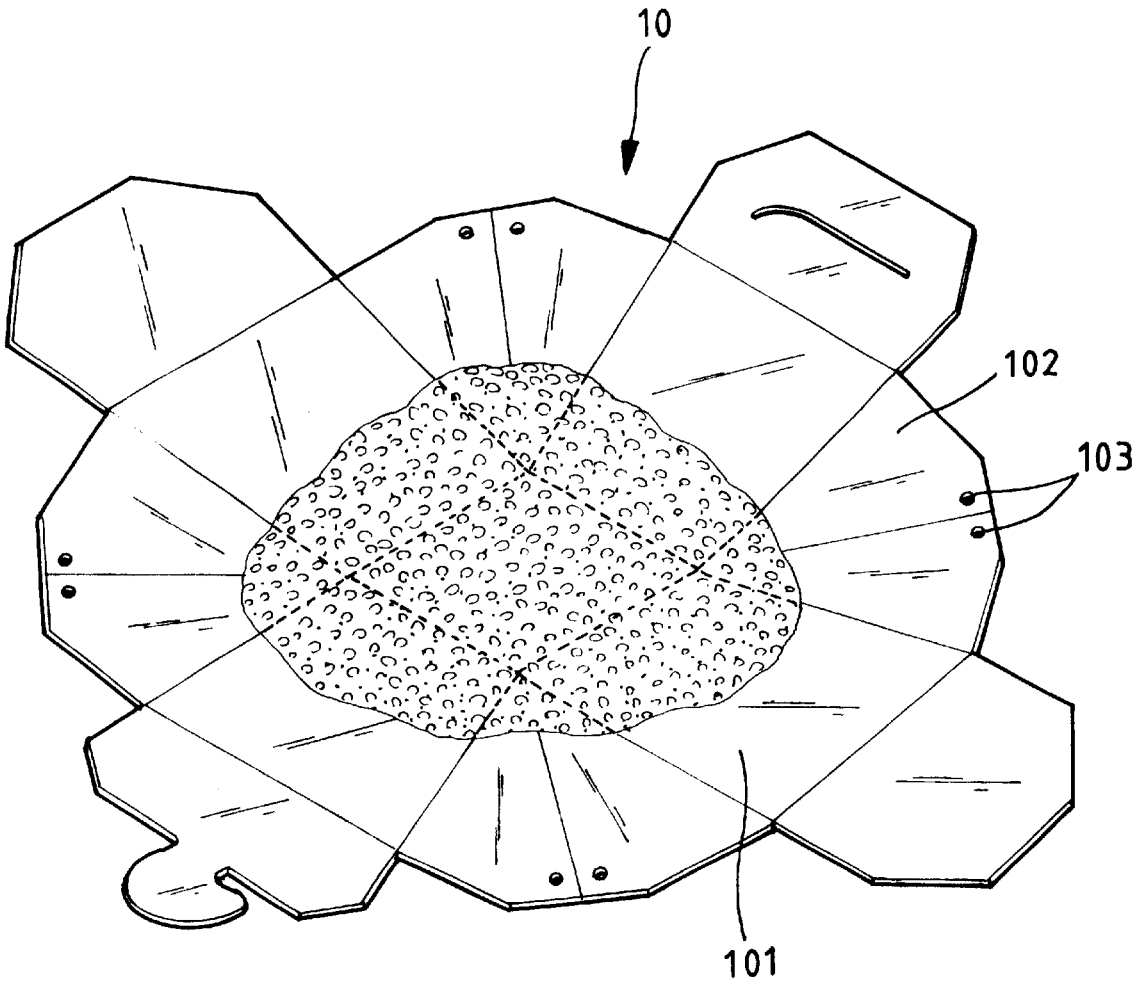
FIG. 23 is a developed view of the lunchbox.

The present invention utilizes the two positioning pieces 4L, 4R fixing the lunchbox 10 in place and a cross bar 1 between which the upper and lower overlapping pieces 2L, 2R, 3L, 3R are provided. In accordance with different use, the upper and lower overlapping pieces 2L, 2R, 3L, 3R can be developed or folded into place through the engaging structure. Thus, the carrying can be facilitated without affecting the piling of the lunchboxes 10. As shown in FIGS. 21 and 22 (to take the first embodiment as example), before enjoying the food, it's only required to detach the finger-shaped fasteners 43 of the two positioning pieces 4L, 4R of the lunchbox C', C" from the connection holes 103. As a result, the lunchbox 10 can be rapidly developed as shown in FIG. 23 like the food received in a dish. Moreover, the material of the present invention is not metallic so that the present invention can be microwave-heated together with the lunchbox 10. Furthermore, it can be properly folded without affecting the piling of the lunchboxes 10. Thus, the use is much facilitated.

Many changes and modifications in the above-described embodiments of the invention can, of course, be carried out without departing from the scope thereof.

Accordingly, to promote the progress in science and the useful arts, the invention is disclosed and is intended to be limited only by the scope of the appended claims.

What is claimed is:

1. A foldable carrying handle used for a portable lunchbox, made of plastic and having seven pieces which are hingedly interconnected into one-part bar-shaped body and comprising:

a cross bar having the same width as said lunchbox and positioned at the center of said bar-shaped body;

two upper overlapping pieces symmetrically disposed at both ends of said cross bar and hingedly interconnected thereto through slimmer inner edges in such a way that top slots formed are directed outwards;

two lower overlapping pieces symmetrically disposed at outer ends of both upper overlapping pieces and hingedly interconnected thereto through slimmer outer edges in such a way that middle slots formed are directed inwards; and two positioning pieces symmetrically disposed at outer ends of both lower overlapping pieces and hingedly interconnected thereto through slimmer inner edges in such a way that lower slots formed are directed outwards, a finger-shaped fastener being positioned on the inner side of said positioning pieces, respectively;

wherein said finger-shaped fasteners of said two positioning pieces are inserted into connection holes at both sides of said lunchbox in such a way that said cross bar is situated atop while said upper overlapping pieces and said lower overlapping pieces vertically extend at both sides of said cross bar, thereby forming an inverted U-shaped carrying handle, and wherein said upper overlapping pieces and said lower overlapping pieces are inwardly folded at said edges when said cross bar is pressed downwards; and wherein two locking studs are arranged on the inner side of said cross bar, and wherein in folding the above-mentioned carrying handle, said locking studs go through the through holes of said upper overlapping pieces, respectively, so that they are locked in place within said positioning holes.

2. The foldable carrying handle as claimed in claim 1 wherein said locking studs arranged on the inner side of said cross bar is formed with said cross bar into one body, and wherein the outer end of said locking studs is thickened.

3. The foldable carrying handle as claimed in claim 1 wherein said two positioning pieces are placed on both sides of said lunchbox in upright state in such a way that the lower slots just lean against the edge of said lunchbox.

4. A foldable carrying handle used for a portable lunchbox, made of plastic and having seven pieces which are hingedly interconnected into one-part bar-shaped body and comprising:

a cross bar having the same width as said lunchbox and positioned at the center of said bar-shaped body;

two upper overlapping pieces symmetrically disposed at both ends of said cross bar and hingedly interconnected thereto through slimmer inner edges in such a way that top slots formed are directed outwards;

two lower overlapping pieces symmetrically disposed at outer ends of both upper overlapping pieces and hingedly interconnected thereto through slimmer outer edges in such a way that middle slots formed are directed inwards; and two positioning pieces symmetrically disposed at outer ends of both lower overlapping pieces and hingedly interconnected thereto through slimmer inner edges in such a way that lower slots formed are directed outwards, a finger-shaped fastener being positioned on the inner side of said positioning pieces, respectively;

wherein said finger-shaped fasteners of said two positioning pieces are inserted into connection holes at both sides of said lunchbox in such a way that said cross bar is situated atop while said upper overlapping pieces and said lower overlapping pieces vertically extend at both sides of said cross bar, thereby forming an inverted U-shaped carrying handle, and wherein said upper overlapping pieces and said lower overlapping pieces are inwardly folded at said edges when said cross bar is pressed downwards; and wherein two corresponding protruding pieces are formed at both sides of each of said lower overlapping pieces, and wherein in folding said carrying handle, said protruding pieces are engaged into indentations of said lower overlapping pieces and said cross bar for fixing said carrying handle in place.

5. The foldable carrying handle as claimed in claim 4 wherein said protruding pieces are formed with said lower overlapping pieces into one body, and wherein said protruding pieces are arranged opposite to each other, and wherein said protruding pieces are engaged into said indentations by means of thickened members at the inner side of thereof.

6. A foldable carrying handle used for a portable lunchbox, made of plastic and having seven pieces which are hingedly interconnected into one-part bar-shaped body and comprising:

a cross bar having the same width as said lunchbox and positioned at the center of said bar-shaped body;

two upper overlapping pieces symmetrically disposed at both ends of said cross bar and hingedly interconnected thereto through slimmer inner edges in such a way that top slots formed are directed outwards;

two lower overlapping pieces symmetrically disposed at outer ends of both upper overlapping pieces and hingedly interconnected thereto through slimmer outer edges in such a way that middle slots formed are directed inwards; and two positioning pieces symmetrically disposed at outer ends of both lower overlapping pieces and hingedly interconnected thereto through slimmer inner edges in such a way that lower slots formed are directed outwards, a finger-shaped fastener being positioned on the inner side of said positioning pieces, respectively;

wherein said finger-shaped fasteners of said two positioning pieces are inserted into connection holes at both sides of said lunchbox in such a way that said cross bar is situated atop while said upper overlapping pieces and said lower overlapping pieces vertically extend at both sides of said cross bar, thereby forming an inverted U-shaped carrying handle, and wherein said upper overlapping pieces and said lower overlapping pieces are inwardly folded at said edges when said cross bar is pressed downwards; and wherein two projecting members are arranged at the top of each of said two positioning pieces, and wherein in folding said carrying handle, said projecting members are engaged into engaging indentations at both sides of said cross bar so as to fix said carrying handle in place.

7. The foldable carrying handle as claimed in claim 6 wherein said lower overlapping pieces are hingedly interconnected on both shoulders at both sides of said projecting members.

8. The foldable carrying handle as claimed in claim 6 wherein said engaging indentation has sloping sides which correspond to tapered sides at the top of said projecting member.

* * * * *